United States Patent [19]

Watts

[11] Patent Number: 4,726,743

[45] Date of Patent: Feb. 23, 1988

[54] HYDRAULICALLY DRIVEN DOWNHOLE PUMP

[76] Inventor: John D. Watts, 10700 N.W. Freeway, Ste. 105, Houston, Tex. 77092

[21] Appl. No.: 913,660

[22] PCT Filed: Nov. 23, 1984

[86] PCT No.: PCT/US84/01934

§ 371 Date: Jul. 18, 1986

§ 102(e) Date: Jul. 18, 1986

[87] PCT Pub. No.: WO86/03262

PCT Pub. Date: Jun. 5, 1986

[51] Int. Cl.[4] ..... F04B 47/08

[52] U.S. Cl. ..... 417/400; 91/216 R; 91/216 A; 91/216 B

[58] Field of Search ..... 417/397, 400, 358, 464; 91/216 R, 216 A, 216 B

[56] References Cited

U.S. PATENT DOCUMENTS

| | | | |
|---|---|---|---|
| 2,305,388 | 12/1942 | Price et al. | 91/216 B X |
| 2,805,625 | 9/1957 | Crow | 417/404 |
| 2,862,448 | 12/1958 | Belding | 91/216 B X |
| 3,152,016 | 10/1964 | Drushella | 91/216 B X |
| 3,522,996 | 8/1970 | Bentley et al. | 417/404 |
| 4,118,154 | 10/1978 | Roeder | 417/404 |
| 4,369,022 | 1/1983 | Roeder | 417/571 |

*Primary Examiner*—Leonard E. Smith

[57] ABSTRACT

A hydraulically powered reciprocating downhole pump having improved means for reliable and efficient operation is disclosed in which a reversing valve (8) is hydraulically shifted past center position so as to effect a smooth continuous operation. Inlet valves (5) and outlet valves (86) are provided so as to most fully utilize space available within diameter constraints for rapid and efficient operation.

17 Claims, 8 Drawing Figures

FIG. 3
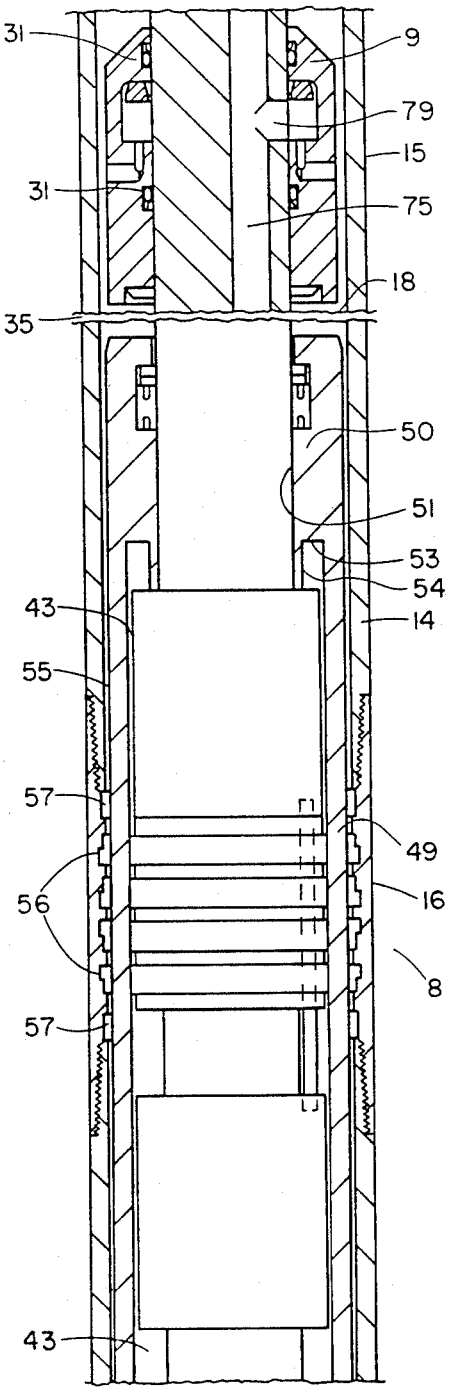
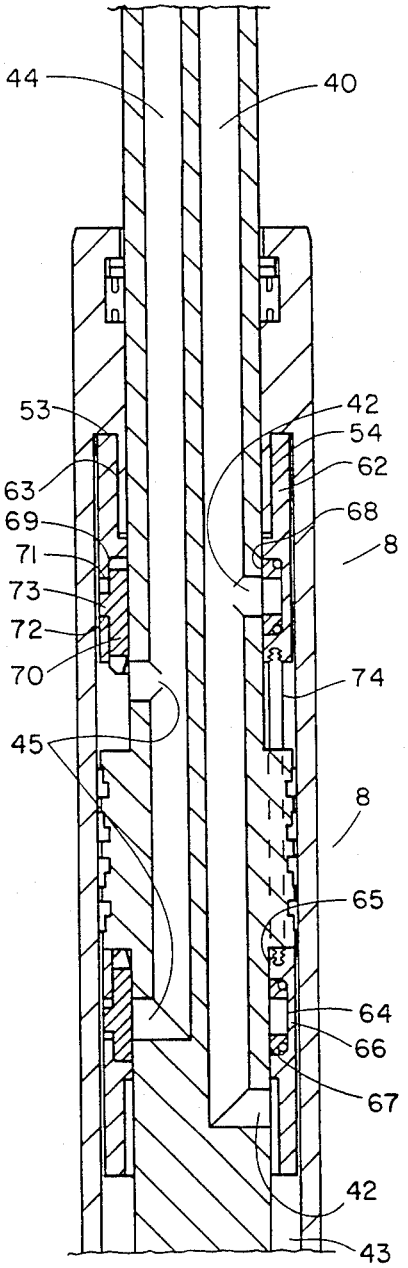
FIG. 6

HYDRAULICALLY DRIVEN DOWNHOLE PUMP

TECHNICAL FIELD

This invention relates generally to methods and means for pumping oil and water from deep wells and, more particularly, to the use of reciprocating pumps powered by pressurized fluids, such as gas, oil or water. Although fluid power has long been used to power such pumps, severe difficulties still exist in the pumps now available, such as sand cutting, sand fouling, vapor locking, excessive use of energy, excessive downtime and excessive replacement of downhole tubing and other equipment.

Although the use of sucker rods to operate a downhole reciprocating pump is the oldest and most wide spread method, the well known high first cost and endless maintenance problems inherent in sucker rod systems have almost become accepted by many operators as inevitable which, unfortunately, drives up the cost of oil and gas, and many "crooked holes" cannot be pumped at all with the use of sucker rods. The practice of "gaslifting" liquids from wells by injecting pressurized gas into a column of liquid within a tubing is well known to be an inefficient system when compressors are required to compress the gas before injection, and, it cannot be used at all in most deep wells of today.

Downhole hydraulically-driven pumps have been used since 1935, but are used in less than 1% of pumping wells today because of excessive maintenance. Typical recommendations for such devices are to change the pump every two months.

Therefore, particularly with regard to such wells as offshore wells, which are generally both deep and directionally drilled, when the pressure of their producing formation declines such that they will no longer flow on their own, a more reliable and efficient method and means for pumping is needed by the industry to gain many millions of barrels of oil and billions of cubic feet of gas, as the present invention provides.

BACKGROUND ART

U.S. Pat. Nos. 2,362,777 and 3,123,007 disclose early systems for hydraulically driving a reciprocating well pump, but neither have bearing on the present invention. Many similar patents exist, some having fluid motors for attachment to conventional pumps or to operate a string of sucker rods, which, in turn, operate a conventional downhole pump.

Coberly U.S. Pat. No. 2,952,212 operates by co-mingling spent power fluid with produced liquid from the well, which requires separation and purification fo the power fluid before recirculation to the downhole pump. A later Coberly patent, U.S. Pat. No. 3,005,414, employs a power fluid string and a separate string to return spent power fluid as well as a production string to convey produced liquid to the wellhead.

Of more particular interest are U.S. Pat. Nos. Hammelmann 3,307,484; Garraway 1,448,486 and Sargent 2,748,712; which generally are of the same type as the present invention. However, all three disclose torturous paths or conduits through which hydraulic fluid must flow in order to operate the pump. The conduits, as depicted, are of small cross section relative to the pumps outer diameter and the conduits also have many changes in direction. Such a device can be jammed by a very minor amount of solid, such as will be found in any hydraulic fluid used to operate a downhole well pump, since the fluid cannot be kept as clean as fluid can be kept in a small surface system.

The severest limitation for a downhole device is the limitation of its outer diameter. Such convenient arrangements as outlet pipe 15 depicted in Garraway, or as outlet pipe 4 depicted in Hammelmann, or side outlets 78*a* as depicted in Sargent, cannot be included in a downhole pump without reducing the abovementioned small flow paths even further, if the pump is to pass downward within typical well tubings.

The small size of the flow paths is even more important when you consider the great increase in pressure drop that is caused by reducing the cross-sectional flow area. Well known laws of hydraulics tell us that given flow rate of a given fluid will produce a pressure drop per unit length of pipe, in direct proportion to the diameter of the flow path raised the fifth power (i.e. should a flow path diameter be reduced to a diameter one third as large, the pressure drop would be increased $(3)^5$, or 243 times the original pressure drop, per unit length, or, perhaps, from 100 psi to 24,300 psi, which would surely render the device impracticable). The importance of providing sufficiently large hydraulic cirucuits that are self-cleaning in downhole hydraulic systems cannot be overstated and it may, therefore, explain substantially the reason that hydraulically-operated downhole pumps have enjoyed less than 1% of the market heretofore, and those few have been of the Coberly type.

In each device of prior art, small conduits must convey fluid to shift the reversing valve before reversal of the pump member can occur. It is, therefore, a primary object of the present invention to provide a dependable and efficient hydraulically-driven downhole pump that does not jam or require excessive pressure to operate.

Another object of the present invention is to provide a reversing valve for a reciprocating pump member which has no conduits necessary for operation, of a flow area smaller than the flow area of the conduit used to convey power fluid to drive the pump.

Still another object of the present invention is to provide a reversing valve for a reciprocating pump member that is shifted by direct action of the power fluid flowing in a conduit used to convey power fluid to drive the pump.

It is also an object of the present invention to provide pressure-aided sealing means to alternately open and close conduits used to convey power fluid to and from the motor chamber.

It is also an object of the present invention to provide means to prevent premature or partial shifting of the reversing valve.

It is also an object of the present invention to provide means to positively, completely and instantaneously shift the reversing valve at the proper time.

It is also an object of the present invention to accomplish such operation of the pump with the least number of moving parts.

It is also an object of the present invention to provide optimum positions of the reversing valve seal members at the instant of hydraulically aided shift.

It is also an object of the present invention to provide suitable inlet valves for the pump chamber so as not to increase the pump outer diameter, but to allow sufficient flow volume to fill the pump chamber for rapid operation of the pump.

It is also an object of the present invention to provide suitable outlet valves for the pump chamber so as not to increase the pump outer diameter, but to allow sufficient flow volume to empty the pump chamber for rapid operation of the pump.

It is also an object of the present invention to provide a suitable valve system such that normal amounts of solids entrained in downhole power fluid and downhole-produced fluid, will not affect the desired operation of the pump adversely.

DISCLOSURE OF THE INVENTION

The present invention provides: a novel reversing valve assembly for reversing the stroke of a hydraulically-driven reciprocating pump member; novel inlet and outlet valves; a cooperating system of valves for reliable and efficient operation of a high pressure, hydraulically-driven reciprocating pump.

Fluid conduits used to convey power fluid to operate the pump member mounted within upper and lower pump chambers are also used to convey fluid to shift the reversing valve when the pump member reaches the end of its stroke. No small flow restrictions or torturous paths are required that may jam or otherwise cause excessive pressure drops of the fluids, the flow paths of the present invention being self-cleaning. Therefore, faster and more reliable operation of the pump may be attained with minimum use of energy.

The reversing valve comprises a pair of annular coaxial rings mounted on a stem and held in fixed, spaced axial relationship by one or more rods; seal members mounted with the rings so as to close or open conduit openings that may be adjacent the bore surface of the rings depending upon the axial position of the rings with respect to the conduit openings, dimensions being such that when the reversing valve is at a first end of its stroke, a first internal chamber of the pump member is open to a pressurized fluid conduit only, while a second internal chamber of the pump member is open to an exhaust fluid conduit only, and when the reversing valve is at a second end of its stroke, the first chamber is open to an exhaust conduit only, and the second chamber is open only to a pressurized fluid conduit.

The first and second internal chambers are divided by a an enlarged section of a cylindrical stem that cooperates with an internal bore of the pump member in sliding and sealing engagement, the rod or rods cooperating with the longitudinal openings in the enlarged section of the stem in sliding and sealing engagement therewith, smaller cylindrical sections of the stem extend axially from both sides of the enlarged section and cooperate with the bore of said rings to position the seal members in sealing engagement with the stem as stated above. Enclosure of each chamber is completed by an end wall of the pump member having a bore provided with means for sliding sealing engagement with the stem. Said first and second internal chambers of the pump member may be known as motor chambers.

The seal members mounted with the rings are formed and positioned such that fluid pressure may act to increase sealing pressure against the stem and around said conduit openings so as to seal the conduits from the motor chambers. The reversing valve assembly is shifted instantaneously, positively and completely by the flow of power fluid moving at a substantially constant flow rate, when the pump member reaches the end of a stroke, so as to provide rapid, dependable and efficient operation of the pump. A pump is thus provided that has no reduced, stagnant or torturous flow paths which may become restricted so as to adversely affect proper operation of the pump.

So as to conserve space within diametrical limits, an inlet valve is formed to seal within each pump chamber end wall so as to intermittently seal the inlet ports in the respective end wall to prevent back flow as during a pressure stroke, and to open efficiently during an intake stroke.

Also, to conserve space within diameter limits, a tubular outlet chamber formed around the stem within the pump chamber intermediate the stroke limit of the plunger and the inlet valves and sealed with the stem by means of end walls formed with the outlet chamber, one of the end walls being formed with outlet ports in communication with the pump chamber so as to receive fluid from the pump chamber during a pressure stroke, an outlet valve formed and positioned to seal the outlet ports intermittently as during an intake stroke of the pump chamber.

BRIEF DESCRIPTION OF THE DRAWINGS

FIGS. 1, 2, 3 and 4, when placed one below the other in that order, depict a vertical section of the present invention, but with lengths of the stem and pump chamber not shown.

FIGS. 5, 6, 7 and 8 are fragmentary views depicting the sequence of operation for the reversing valve of the present invention with the pump chamber wall omitted.

BEST MODE FOR CARRYING OUT THE INVENTION

Figure 1:
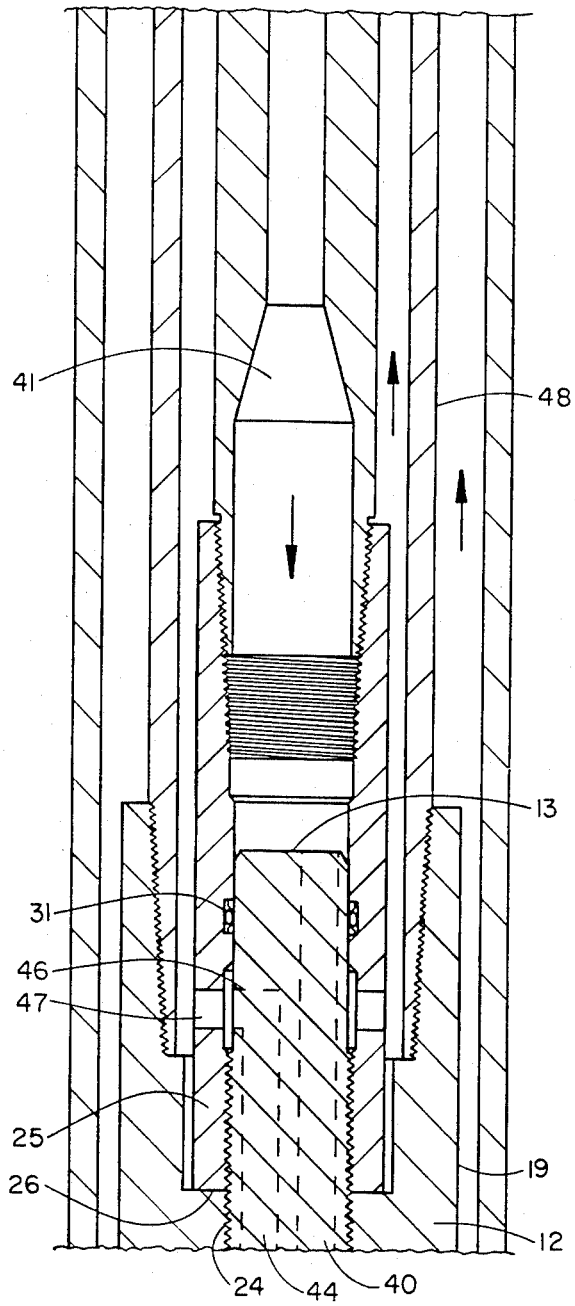

Referring to FIGS. 1, 2, 3 and 4, centrally disposed cylindrical stem 1 extends from the lower-most extremity 2, of the pump assembly upward though threaded nut 3, annular lower body 4, lower inlet disc 5, annular outlet valve assembly shown generally at 6, annular plunger assembly shown generally at 7, annular reversing valve assembly shown generally at 8, annular upper outlet valve assembly shown generally at 9, annular upper inlet disc 10, annular upper body 11, annular hanger 12, to terminate at uppermost extremity 13. A tubular pump chamber wall shown generally at 14, comprising upper and lower jackets 15 when coupled by collar 16, are sealingly connected with upper body 11 and lower body 4 so as to enclose annular lower pump chamber 17 and annular upper pump chamber 18. Lengths of stem 1 and jacket 15 are not shown at 35 and between FIGS. 3 and 4, such lengths being sufficient to allow for the full stroke of plunger assembly 7.

A pump hanger assembly shown generally at 19 comprises hanger 12, conventional seal assembly 20 for sealing with the bore of conventional nipple 21, a part of production tubing string 22, which is used to convey produced well fluid to the wellhead. Hanger 12 is supported on the upper portion of nipple 21 by means of mating shoulders, as at 23, against any downward-acting weights or fluid pressures. Hanger 12 is secured with stem 1 in the desired axial relationship by means of screw threads 24 and locked in place by power collar 25, tightened on threads 24 against an upper shoulder of hanger 12, as at 26. Screw threads 27 formed on the lower outer surface of hanger 12 may be used to secure and lock upper body 11 with, and below, the hanger as well as allow nut 28 to travel on threads 27 to tighten so as to secure seal assembly 20 with the hanger.

Screw threads, as at 29, may be used to secure the upper and lower bodies with jackets 15 and suitable seals, as at 30, are provided to prevent leakage therebetween. Suitable seals 31 are provided along stem 1 to prevent axial leakage between the stem and the members mounted thereon.

Sealing surfaces 32 of the upper and lower bodies are formed with a plurality of openings, as at 33, in communication with the space outside of the pump so as to receive well fluid to be pumped and within which the pump may be immersed. Sealing surfaces 34 of disc 5 are formed for sealing cooperation with surfaces 32 so as to prevent backflow from the pump chambers through openings 33. Disc 5 is of such weight and dimension to act as a check valve, allowing flow through openings 33 into the pump chamber but stopping back flow.

Axial movement of disc 5 is limited by surface 32 and by end surface 36 of outlet valve assembly 6 nearest thereto, so as to prevent restriction of openings 33 during an intake stroke, so as to assure optimum axial travel of disc 5 at the beginning of a pressure stroke. The outer diameter 37 may be of such dimension with respect to the adjacent inner diameter 38 of jacket 15 such that fluid flow therebetween during a pressure stroke will effect a pressure differential across disc 5 and therby effect a sufficient force to instantaneously move disc 5 into sealing engagement with surface 32 so as to close openings 33 as required to attain a high volumetric efficiency of the pump.

Nut 3 may be tightened on screw threads 39, formed on the lower portion of stem 1, against the lowermost surface of lower body 4 so as to effect stem 1 in tension and to effect body 4 jackets 15, collar 16, body 11 and hanger 12 in compression sufficiently to pre-load those members with respect to operating stresses so as to prevent tendency of fatigue failure of said members, the strengths of said members being sufficient so as to allow the required magnitude of pre-load.

Stem 1 may be provided with a first longitudinally disposed conduit 40 formed therein for conveying pressurized power fluid from within power tubing 41 downwardly to upper and lower power ports as at 42, which may provide communication alternately to upper and lower motor chambers 43 formed within plunger assembly 7. Power tubing 41 may extend to the wellhead so as to convey pressurized power fluid from a suitable surface-mounted hydraulic power source such as is disclosed in my co-pending application filed herewith entitled "Method and Means to Pump a Well". Stem 1 may also be formed with a second longitudinally disposed conduit 44 formed therein for conveying exhaust fluid alternately from upper and lower exhaust ports 45 in communication respectively with upper and lower motor chambers 43, upwardly to exit the stem through side port 46 of stem 1 and thence through side port 47 formed through the lower wall of power collar 25 so as to return upwardly to the power source through the annulus return tubing 48, suitably connected with the wellhead. Outer surface 55 of tubular member 49 may be hard, smooth and polished so as to cooperate with annular sliding seals as at 56 within collar 16 so as to prevent communication of fluid between upper and lower pump chambers 17 and 18, and with the least wear and friction. Carbide seal rings 57 may be provided to exclude sand, as described in my co-pending U.S. application Ser. No. 421,503.

Figure 5:
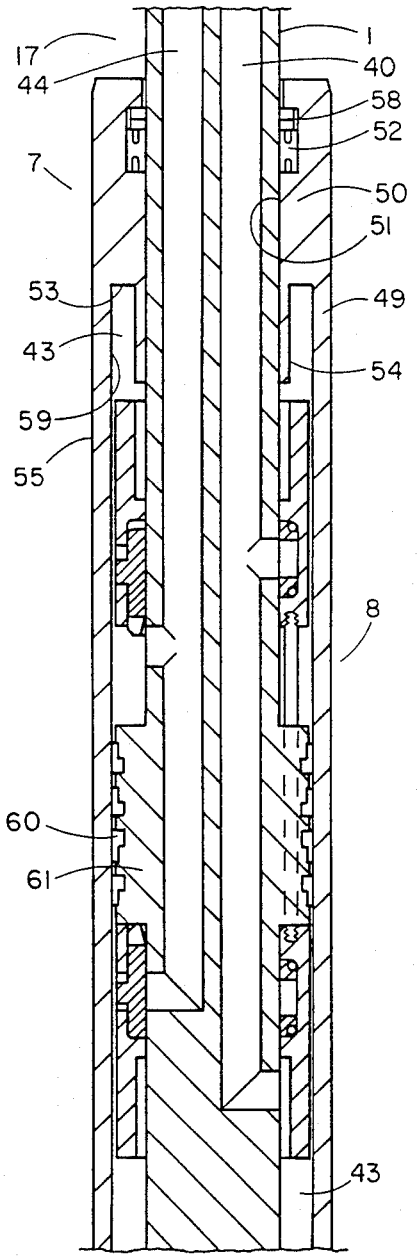

Now, referring to FIG. 5, plunger assembly 7 may comprise tubular member 49 having upper and lower end walls at 50 formed with reduced bore 51 to provide sliding engagement with a portion of stem 1. Seals 52 provided within bore 51 for sliding sealing engagement with a polished portion of stem 1, prevent communication of power fluid and well fluid between the motor chamber 43 and pump chambers as at 17. End wall 50 may be formed with shoulder 53 and annular extension 54 for purposes to be later described.

Carbide seals 58 may also be provided to exclude sand as described in my co-pending application.

Inner surface 59 of tubular member 49 may be hard, smooth and polished so as to cooperate with annular sliding seals as at 60 around enlarged section 61 of stem 1 so as to prevent communication of fluid between upper and lower motor chambers and with least wear and friction.

Now, referring to FIG. 6, reversing valve assembly 8 may comprise upper and lower annular rings, as at 62, formed with enlarged bore 63 positioned and dimensioned for intermittent cooperation with extension 54 so as to provide a substantial restriction to fluid flow when a side-by-side relationship of the two occurs. The outermost surfaces of ring 62 is dimensional so as to allow an annular flowpath around ring 62 and within tubular member 49. Each ring 62 may also comprise a radially positioned recess 64 extending from bore 65 of ring 62 to end wall 66 formed within ring 62. Annular seal member 67 may be formed with surface 68 for sliding sealing cooperation with stem 1 and may be formed for sealing cooperation with recess 64 so as to provide a seal area greater than the innermost seal area of surface 68, such that pressurized fluid within recess 64 will force member 67 against stem 1 and effect a tight fluid seal between surface 68 and the stem. Recess 64 is positioned within bore 65 such that when ring 62 is at a limit of axial stroke farthest from section 61, as depicted at upper power port 42 of FIG. 6, surface 68 is positioned around power port 42 so as to prevent flow of pressurized fluid from that port. Spacing of upper and lower ports 42 is such that when ring 62 is at a limit of axial stroke nearest section 61 as depicted by the lower ring 62 of FIG. 6, port 42 is in full communication with lower motor chamber 43.

Ring 62 may also be formed with recess 69 to receive seal member 70, which is formed and dimensioned to seal against the stem around exhaust port 45 when ring 62 is positioned adjacent section 61. Upper shoulder 71 and lower shoulder 72 may be formed within recess 69 so as to cooperate with lug 73 projecting from member 70 for the purpose of providing a predetermined limited axial movement of member 70 with respect to ring 62, so as to effect valve timing as later disclosed. Recess 69 is positioned within bore 65 such that when ring 62 is at a limt of axial stroke farthest from section 61, as depicted by the upper ring of FIG. 6, member 70 is axially spaced from port 45, which is in full communication with upper motor chamber 43. Spacing of upper and lower ports 45 is such that when ring 62 is at a limit nearest section 61, as depicted by the lower ring 62 of FIG. 6, member 70 blocks lower port 45 such that pressure within the lower motor chamber acts to force member 70 into tight sealing engagement against the stem around lower port 45, thereby preventing flow through lower port 45.

One or more rods, as at 74, connect upper and lower rings 62 in spaced axial relationship such that axial movement of one ring along the stem effects like movement of the other ring, rod 74 cooperating with axially-aligned openings through section 61 so as to affect a sliding seal to prevent communication between the motor chambers and to prevent rotation of rings 62 around the stem. The cross-sectional area of rods 74 is a small fraction of the cross-sectional area of the motor chamber such that differential pressure across section 61 will hold valve assembly 8 against premature shifting; such that normal force of the plunger will shift assembly 8.

Figure 8:
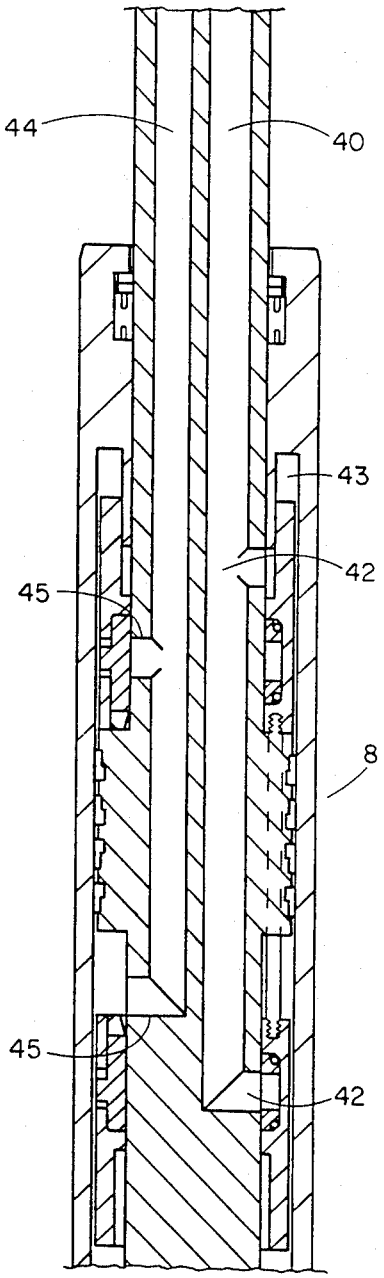
Figure 2:
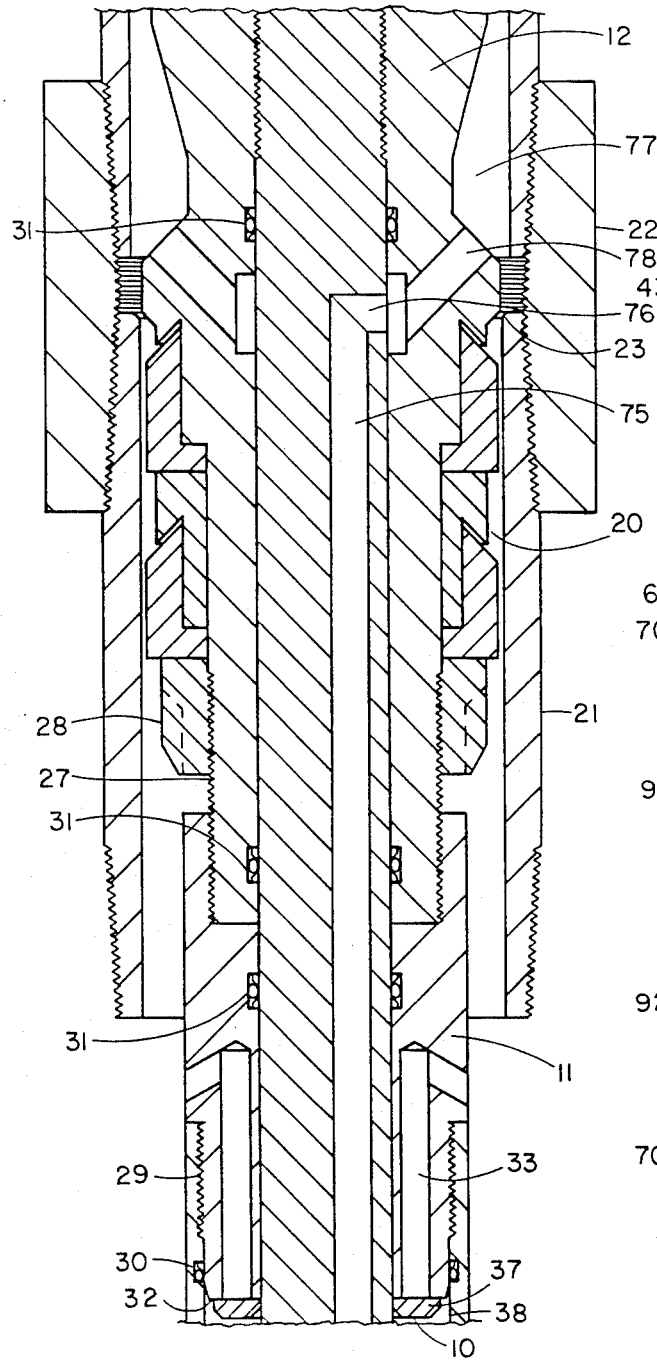

It is thus clear that when valve assembly 8 is in the position depicted in FIG. 6: flow from conduit 40 cannot enter the upper motor chamber, but it can enter the lower motor chamber; flow from the upper motor chamber can exahaust into conduit 44, but it cannot exhaust from the lower motor chamber, thus pressurized fluid within the lower motor chamber will cause the plunger assembly to move downward. Likewise, when valve 8 is at the lower limit of its stroke, as depicted in FIG. 8, power fluid will cause the plunger assembly to move upward. When at a stroke limit, the reversing valve is held against premature shifting by friction between member 67 farthest from section 61 and by member 70 nearest section 61, those being the seal members then sealing and by the differential pressure acting across section 61 on rods 74.

Figure 7:
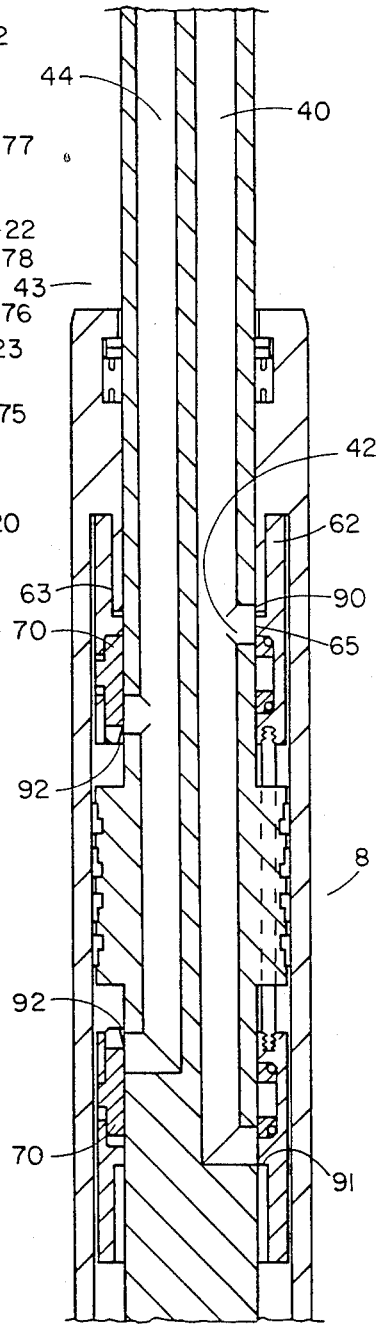
Figure 4:
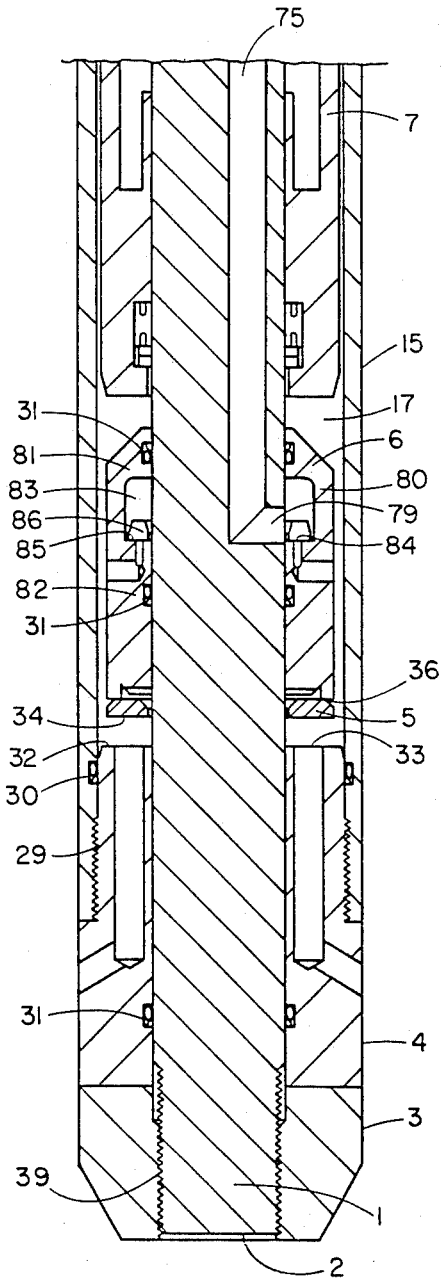

The axial spacing ports of 42 with respect to recesses 66 and the axial spacing of ports 45 with respect to recesses 69 is such that an axial position of valve assembly 8 intermediate its stroke limits, may effect a port timing, as depicted in FIG. 7, wherein: the valve is being shifted downwardly, bore 65 of upper ring 62 has moved past the upper extremity 90 of upper port 42, now the rear port, and thereby exposed a minor portion of flow area of the port such that pressurized fluid can flow from counduit 40 into bore 63 of ring 62; bore 65 of lower ring 62 has moved to substantially block flow from lower port 42, as at 91, now the foreward port; both upper and lower seal members 70 block all but a minor portion of flow area of their respective ports 45, as at 92, allowing a combined flow rate of fluid into exhaust conduit 44 sufficient to allow continuous flow into exhaust conduit 44 and therefore allow continuous flow of pressurized fluid from conduit 40 so as to prevent hydraulic shock during shifting of the reversing valve and to provide a smooth reversal of the plunger assembly while not losing enough fluid power to prevent proper operation of the pump. I have found that an open area of ports 45 in the order of one-eighth ($\frac{1}{8}$) of the full opening area for this timing, will allow proper operation of the pump. Upper seal member 70, while partially blocking port 45, is held against stem 1, by fluid pressure flowing into conduit 44 and is, therefore, held by friction against the stem to prevent its falling, within limits of axial movement relative to the ring as defined above. However, since the frictional force holding seal member 67 and 70 upward is small with respect to the force shifting the reversing valve, the seal members are easily pushed along the stem. Should members 70 not have been provided with limited axial movement with respect to the rings, inspection of FIG. 7 makes it obvious that the timing as above described would not be possible if the reversing valve were moving upward, in that the new lead port 42 would be open, instead of closed, and the new trailing port 42 would be closed instead of open. However, since seal members 70 do have said limited axial movement, friction between members 70 and the stem will be acting downward upon upward shifting of this reversing valve to effect the desired port timing as before described. The relative positions of the rings, the seal member and their respective ports as depicted in FIG. 7 herein shall be called the shift position hereafter.

So as to convey well fluid to the surface, the stem may be formed with a third longitudinally disposed conduit 75 extending from opening 76 in the wall of the stem which is in communication with annulus 77 within production tubing string 22 by means of port 78 through the wall of hanger 12, to connect with openings 79 through the wall of the stem positioned so as to communicate with outlet valves 6 and 9. Each outlet valve comprises tubular shell 80 having end walls of reduced diameter, as at 81 and 82, so as to form annular outlet chamber 83 and to seal against the stem. Shell 80 may be retained against axial movement along the stem as by a set screw through lower endwall 82. The inner surface of endwall 82 may have openings 84 in communication with the enclosing pump chamber, formed through sealing surface 85. An annular outlet disc 86 may be provided within chamber 83, formed for sealing engagement with surface 85 so as to prevent backflow from chamber 83 to the pump chamber. Disc 86 may be of such dimensions and of such weight so as to allow fluid to flow from the pump chamber into the outlet chamber with no appreciable resistance.

Operation of the pump may now be understood. As shown in FIG. 5, a fluid of sufficient pressure may flow from conduit 40 into lower motor chamber 43 to act axially against stem section 61 and against lower endwall 50 to thereby force plunger assembly 8 downward to pressurize well fluid accumulated into lower pump chamber 17 and to force the well fluid through outlet valve 6 and thence, into conduit 75 upward through openings 76 and 78 into annulus 77 to the wellhead, inlet disc 5 being sealed by cooperation of surfaces 32 and 34. Simultaneously, upper outlet valve 9 prevents flow into upper pump chamber 18 which is receiving well fluid through intake ports 33, disc 32 being open as carried by the differential pressure across the disc. Also, resulting contractions of the upper motor chamber causes fluid to be exhausted into conduit 44 and thence to the wellhead. As downward motion of the plunger reaches the position as depicted in FIG. 6, extension 54 has displaced a minor amount of fluid from enlarged bore 63 of ring 62 and shoulder 53 of end wall 50 has contacted the upper surface of upper ring 62, the end thrust against ring 62 caused by displacement of fluid, not being of sufficient force to overcome resisting forces as described above. Further downward movement of the plunger from the position depicted in FIG. 6 to the position depicted in FIG. 7 causes downward movement of the reversing valve to the shift position as previously described. At the shift position, the flow of pressurized fluid is introduced in increasing volume into enlarged bore 63 so as to act axially against the lowermost surface of extension 54 which stops downward movement of the plunger and also acts axially against ring 62 so as to accelerate downward movement of the reversing valve to the stroke limit, to thereby reliably provide a complete and instantaneous shift of the reversing valve so as to effect smooth, rapid and efficient operation of the pump. After downshift of the reversing valve to the position depicted in FIG. 8, valve positions are reversed to those shown in FIG. 5 so as to effect an upstroke of the plunger and thence continued operation of this double-acting reciprocating pump.

I claim:

1. A pump having a reciprocating annular pump member positioned within a pump chamber, the pump member slidably and sealably mounted around a centrally disposed cylindrical stem mounted at each end with an end wall of the pump chamber, the stem being formed with two or more longitudinally disposed conduits therein, a first conduit being positioned so as to convey pressurized fluid to within the pump member so as to operate the pump, a second conduit being positioned so as to convey exhaust fluid from within the pump member, the stem being formed with an enlarged cylindrical section positioned within the pump member and having means to effect a sliding seal with an inner cylindrical surface of the pump member, comprising: said stem being formed with a third longitudinally disposed conduit for conveying fluid to be pumped from the pump chamber upwardly toward the wellhead; said third conduit having one or more radial ports extending through the stem's surface within the pump chamber and positioned beyond the axial limit of the pump member stroke; a tubular shell sealingly mounted around the stem so as to provide an annular outlet chamber around the stem in communication with the third conduit; an end wall of the shell being formed with outlet ports in communication with the pump chamber around the shell so as to receive fluid being pumped into the shell; an annular outlet valve of metal or the like mounted and formed so as to cooperate with the end wall of the shell and thereby close said outlet ports and intermittently prevent flow from the outlet chamber through said outlet ports during a suction stroke; the outlet valve being of such weight and dimension such that fluid being pumped from the pump chamber will move the outlet valve and enter the outlet chamber during a pressure stroke.

2. The invention of claim 1, wherein: sealing surfaces of the valve and end walls are harder than sand or the like that may be entrained in the fluid being pumped.

3. The system of claim 2 further comprising: fast-acting inlet and outlet valves to and from a pump chamber in which the pump member is mounted, such that rapid and efficient action of the pump may result.

4. A pump having a reciprocating tubular pump member positioned within a pump chamber, the pump member slidably and sealably mounted around a centrally disposed cylindrical stem mounted at each end with an end wall of the pump chamber, the stem being formed with two or more longitudinally disposed conduits therein, a first conduit being positioned so as to convey pressurized fluid to within the pump member so as to operate the pump, a second conduit being positioned so as to convey exhaust fluid from within the pump member, the stem being formed with an enlarged cylindrical section positioned within the pump member and having means to effect a sliding seal with an inner cylindrical surface of the pump member so as to form upper and lower motor chambers within the pump member, comprising: a reversing valve formed with an upper annular ring mounted around the stem in the upper motor chamber; a lower annular ring mounted around the stem in the lower motor chamber; one or more longitudinally disposed rods extending sealably through suitable openings through said enlarged section for connecting said rings in spaced relationship such that axial movement of one ring will cause like movement of the other ring; said rings having predetermined axial stroke limits; each ring having means for closing an opening between its respective motor chamber and the first conduit when at the limit farthest from the enlarged section; each ring having means for closing an opening between its respective motor chamber and the second conduit when at the stroke limit closest to the enlarged section.

5. The invention of claim 4, further comprising: the pump member being a hollow plunger.

6. The invention of claim 4, further comprising: the pump member being a hollow piston.

7. A valve system for operating a hydraulically-driven reciprocating pump member of claim 1 comprising: conduits used to convey fluid as required to cause stroke reversal, being of substantially the same flow area as are conduits used to convey power fluid to drive the pump member.

8. The invention of claim 1 further comprising: the pump chamber end walls being formed with intake ports in communication with the space outside of the pump so as to receive fluid to be pumped into the respective pump chamber during a suction stroke; the intake ports having check valves therein mounted so as to prevent flow through the intake ports of the respective pump chamber during a compression stroke.

9. The invention of claim 4, wherein means within each ring for closing an opening to the first conduit comprise: a radially positioned first recess within the ring, extending from the inner diameter thereof and terminating at an end wall formed within the ring; the first recess having a perimeter greater than the perimeter of the respective outlet of the first conduit; the first recess being positioned so as to encompass its respective outlet when the ring is at the limit farthest from said enlarged section; a first seal member formed positioned within the recess and having means for sliding sealing engagement with the stem around its respective outlet; said first seal member having means for sliding sealing engagement with an inner surface of the first recess; a flow passage formed through the first seal member positioned so as to allow fluid from the first conduit to enter the recess when that recess may encompass such conduit opening so as to force said first seal member into tight sealing engagement with the stem; so as to stop fluid flow from the first conduit.

10. The invention of claim 4 wherein the means within each ring for closing an opening to the second conduit comprise: a seal member formed for sliding and sealing engagement with the stem; said seal member being of suitable dimensions and positioned within the ring so as to block the opening to the second conduit when the ring is at the stroke limit nearest the enlarged section, such that fluid flow may be prevented from flowing into the second conduit; such that fluid pressure against the seal member acts to improve the seal.

11. The invention of claim 10, wherein the ring may have a limited predetermined movement along the stem, relative to the second seal member.

12. The inventions of claims 9 or 10 further comprising: either of the rings being at its stroke limit nearest said enlarged section of the stem when the other ring is at its stroke limit farthest from said enlarged section of the stem; such that when pressurized fluid is flowing into the lower motor chamber, exhaust fluid is flowing from within the upper motor chamber; such that when pressurized fluid is flowing into the lower motor chamber, exhaust fluid is flowing from within the upper motor chamber so as to operate the pump.

13. The invention of claim 4, further comprising: holding means to hold the reversing valve at an uppermost stroke limit and holding means to hold the reversing valve at a lowermost stroke limit, against premature shifting.

14. The invention of claim 13 further comprising: shifting means to overcome said holding means at a point of shift near the end of each stroke limit of the reciprocating pump member, so as to shift the reversing valve and thereby cause the pump member to reciprocate.

15. The invention of claim 14, wherein shifting means comprise: internal end walls of the annular pump member being formed so as to push against and to effect an annular seal with each respective ring such that, as a given end wall moves toward and contacts its respective ring, the rings are moved axially along the stem to thereby cause the ring being pushed by the end wall to partially open the first conduit so as to cause power fluid to flow into the space within the annular seal formed between the ring and the end wall so as to develop an axial hydraulic thrust to thereby cause the reversing valve to shift fully without further movement of the pump member.

16. The invention of claim 15, wherein said end wall comprises a cylindrical surface that cooperates with a mating cylindrical surface of the ring so as to restrict flow of power fluid from the ring and thereby develop an axial hydraulic thrust against the ring of a force and for a distance sufficient to complete the shift of the reversing valve.

17. The invention of claim 15 or 16 further comprising, at either limit of the pump member stroke: the ring being pushed by an end wall, causing the first conduit to have approximately one-eighth ($\frac{1}{8}$) of its flow area open and causing the second conduit to have approximately one-eighth ($\frac{1}{8}$) of its flow area open; the other ring causing the second conduit to have approximately one-eighth ($\frac{1}{8}$) of its flow area open and causing the first conduit to be substantially closed.

* * * * *